US010156139B2

(12) United States Patent
Chen et al.

(10) Patent No.: US 10,156,139 B2
(45) Date of Patent: Dec. 18, 2018

(54) DEVICE FOR BACK SOIL DISTURBANCE IN SHIELD TUNNEL

(71) Applicant: POWERCHINA HUADONG ENGINEERING CORPORATION LIMITED, Hangzhou, Zhejiang province (CN)

(72) Inventors: Wenhua Chen, Hangzhou (CN); Jing Hou, Hangzhou (CN); Jie Zhang, Hangzhou (CN); Yangchun Dai, Hangzhou (CN); Kewei Cui, Hangzhou (CN)

(73) Assignee: POWERCHINA HUADONG ENGINEERING CORPORATION LIMITED (CN)

( * ) Notice: Subject to any disclaimer, the term of this patent is extended or adjusted under 35 U.S.C. 154(b) by 140 days.

(21) Appl. No.: 15/245,143

(22) Filed: Aug. 23, 2016

(65) Prior Publication Data

US 2017/0335687 A1 Nov. 23, 2017

(30) Foreign Application Priority Data

May 20, 2016 (CN) ..... 2016 1 0341630

(51) Int. Cl.

| | |
|---|---|
| ***E21D 9/01*** | (2006.01) |
| ***E21D 9/10*** | (2006.01) |
| *E21C 45/00* | (2006.01) |
| *E21D 11/00* | (2006.01) |
| *E21D 9/00* | (2006.01) |

(52) U.S. Cl.

CPC ..... *E21D 9/01* (2016.01); *E21D 9/1066* (2013.01); *E21C 45/00* (2013.01); *E21D 9/001* (2013.01); *E21D 11/003* (2013.01)

(58) Field of Classification Search

CPC ..... E21D 9/01; E21D 11/105; E21D 11/003; E21C 45/00; E21C 45/02; E21C 45/04; E21C 45/06; E21C 45/08; E21B 7/18; E21B 33/1272; E21B 43/29; E21B 43/292; E21B 33/127; E21B 33/1275; E21B 33/1277

USPC ..... 405/146, 150.1

See application file for complete search history.

(56) References Cited

U.S. PATENT DOCUMENTS 1,994,884 A * 3/1935 Chew ..... E21C 45/00 175/313
3,492,827 A * 2/1970 Stevens ..... E21D 11/105 264/30
5,527,135 A * 6/1996 Hayashi ..... E21B 7/20 405/141

FOREIGN PATENT DOCUMENTS

EP 1072754 A2 * 1/2001 ..... E21B 7/20

* cited by examiner

*Primary Examiner* — John J Kreck
*Assistant Examiner* — Michael A Goodwin
(74) *Attorney, Agent, or Firm* — PROI Intellectual Property US

(57) ABSTRACT

The present invention relates to an apparatus for soil disturbance at the back of a shield tunnel, wherein: the apparatus is formed by a fitting I and a fitting II connected by means of three bolts that form equal angles; the fitting I is a short circular pipe; an end surface of a fitting end of the fitting I is provided with a water passage; a pipe wall of the pipe is provided with 2-8 water spouts; the fitting II is a long circular pipe whose inner and outer diameters are consistent with those of the fitting I; a fitting end of the fitting II is provided with two O-shaped water stop rings; a pipe wall of (Continued)

the fitting II is provided with three water inlets that form equal angles and are in communication with the water passage of the fitting I.

3 Claims, 4 Drawing Sheets

DEVICE FOR BACK SOIL DISTURBANCE IN SHIELD TUNNEL

CROSS REFERENCE TO RELATED APPLICATIONS

The present application claims priority to Chinese Patent Application CN 2016 103 416 30.4 filed on May 20, 2016.

TECHNICAL FIELD

The present invention relates to an apparatus for soil disturbance at the back of a shield tunnel, which is applied to correction of a shield tunnel after the shield tunnel is deformed, and to rectification of differential settlement or horizontal displacement of the shield tunnel.

BACKGROUND

A shield tunnel is widely used in underground engineering of city utilities, transportation, etc. During construction and operation processes, due to impacts of geological conditions, construction factors, changes of the surrounding environment, etc., problems such as cross-shield tunnel "duck egg-shaped" deformation, longitudinal differential settlement, and uneven horizontal displacement may occur in a shield tunnel, leading to shield segment cracking and water leakage, which cause hazard to structural safety of the shield tunnel and may severely affect engineering safety and the operation safety of the subway if not being resolved timely. To resolve such problems, currently, carrying out grouting reinforcement on soil or applying a steel ring to an inner side of a shield tunnel for reinforcement is usually used. However, the former solution brings unfavorable impacts to shield tunnel structure stress, and the latter involves difficult construction and high costs.

SUMMARY

A technical problem resolved by the present invention is that: in view of the foregoing problems, the present invention provides an apparatus for soil disturbance at the back of a shield tunnel, so that rotating water flow generated from high pressure water by using this apparatus cuts soil, and a pressure difference of soil and water inside and outside the soil after disturbance is used, so as to dump the soil and water from a central hole of this apparatus; besides, in addition to being capable of excavating and dumping soil and water, this apparatus can be connected to an external measurement system, and this apparatus can perform grouting reinforcement on disturbed soil.

A technical solution used in the present invention is an apparatus for soil disturbance at the back of a shield tunnel, wherein the apparatus comprises a fitting I and a fitting II connected by means of three bolts that form equal angles;

the fitting I is a short circular pipe; an end surface of a fitting end of the fitting I is provided with a water passage; a pipe wall of the pipe is provided with 2-8 water spouts 2; and an angle of 60° is formed between each of the water spouts 2 and a radial direction;

the fitting II is a long circular pipe whose inner and outer diameters are consistent with those of the fitting I; a fitting end of the fitting II is provided with two O-shaped water stop rings; a pipe wall of the fitting II is provided with three water inlets that form equal angles and are in communication with the water passage of the fitting I; an outer wall of a middle part of the fitting II is provided with a leather bag; the leather bag is in communication with a water stop leather bag pressurization hole by using a radial water stop leather bag pressurization passage; the water stop leather bag pressurization hole and communication ports of the water inlets are located at an end other than the fitting end; and centers of the fitting I and the fitting II are provided with axially through soil and water excavating and dumping holes, and diameters of the two soil and water excavating and dumping holes provided on the two fittings are the same.

An outer diameter of the fitting I is 70-110 mm; a wall thickness is 15-20 mm; a diameter of each of the water spouts 2 is 10-12 mm; the water passage is an annular groove with a groove depth of 1-2 mm; and three bolt holes used to connect the fitting II are distributed with an angle of 120° between each two of the bolt holes.

The fitting II is provided with three blind holes corresponding to the three bolt holes on the fitting I, and a hole depth is 10-15 mm.

Beneficial effects of the present invention are not only to cut soil and to block or discharge soil/water, but also the following: with the present invention, high-speed rotating water flow generated from high pressure water by using this apparatus cuts and disturbs soil, and a pressure difference of soil and water inside and outside the soil after disturbance is used, so as to dump the soil and water from a central hole of this apparatus; besides, this apparatus can block soil and water dumping, can disturb the soil in a particular range at the back of a segment by using high pressure water, can excavate and dump soil and water, can perform grouting reinforcement on disturbed soil, and the like. The present invention is simple, practical, economical, safe, and has good economical and social benefits.

DETAILED DESCRIPTION

An apparatus for soil disturbance at the back of a shield tunnel of this embodiment is a cylindrical integral body formed by a fitting I and a fitting II connected by means of three bolts that form equal angles of 120°.

Figure 1:
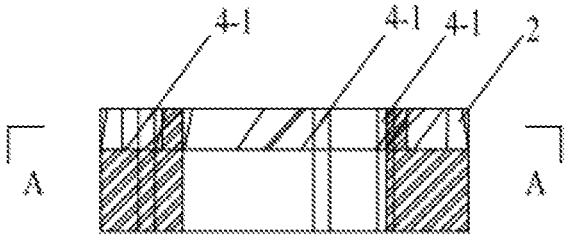
FIG. 1 is a longitudinal sectional view (B-B section) of a fitting I according to an embodiment of the present invention.
Figure 2:
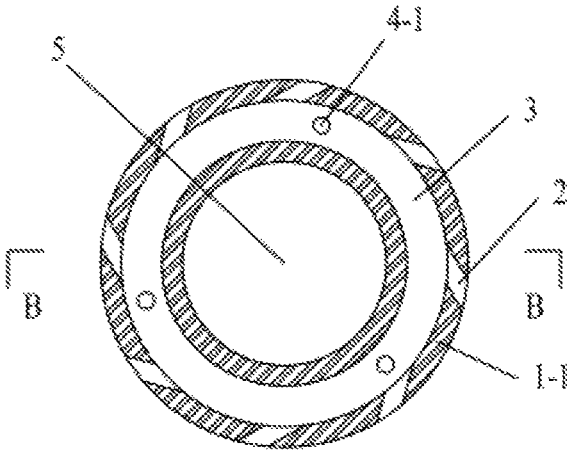
FIG. 2 is a cross sectional view (A-A section) of the fitting I according to the embodiment of the present invention.

As shown in FIG. 1 and FIG. 2, the fitting I is a short circular pipe 1-1; an outer diameter of the fitting I is 70-110 mm; an inner diameter is not less than 40 mm; a wall thickness is not less than 15 mm, and an end surface of a fitting end of the short circular pipe 1-1 is provided with a water passage 3; the water passage 3 is an annular groove with a groove depth of 1 mm; a pipe wall at an outer side of the water passage is provided with eight water spouts 2 whose diameters are not less than 10 mm; an angle of 60° is formed between each of the water spouts 2 and a radial direction; three bolt holes 4-1 are disposed at the bottom of the water passage 3, and are used to connect the fitting II; and an angle between each two of the three bolt holes is 120°.

Figure 3:
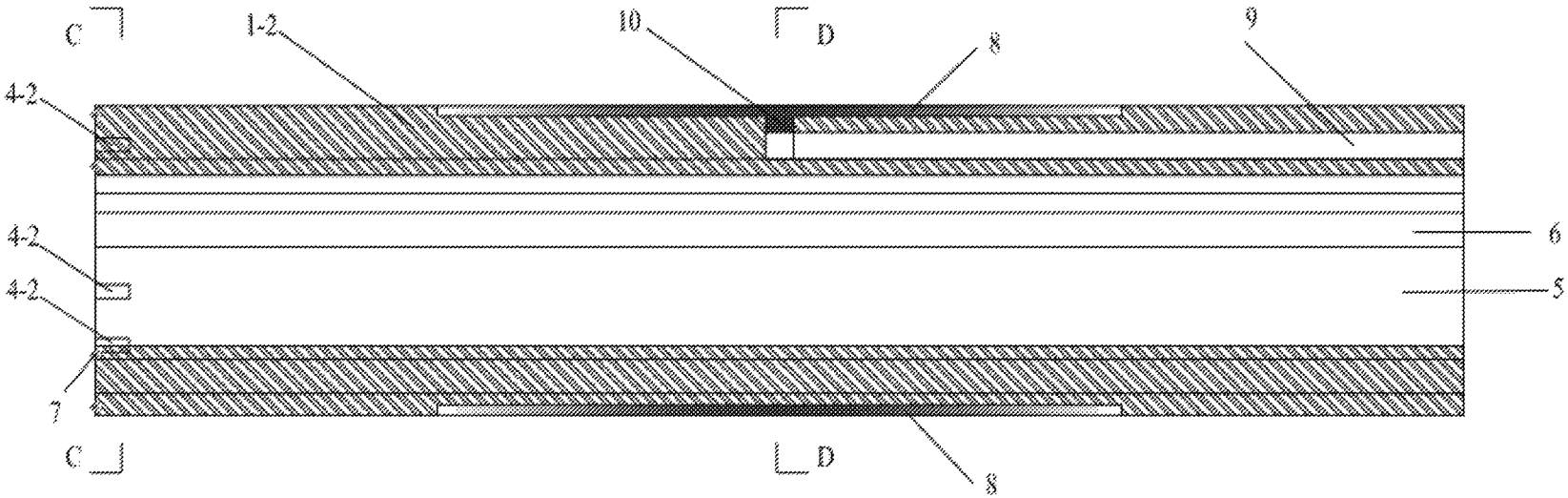
FIG. 3 is a longitudinal sectional view (E-E section) of a fitting II according to the embodiment of the present invention.
Figure 4:
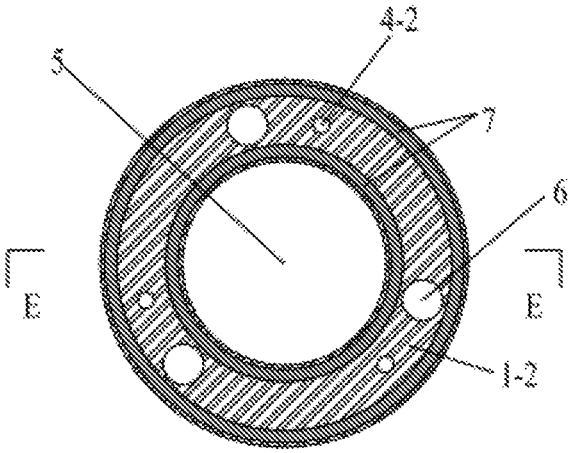
FIG. 4 is a cross sectional view (C-C section) of a fitting end of the fitting II according to the embodiment of the present invention.
Figure 5:
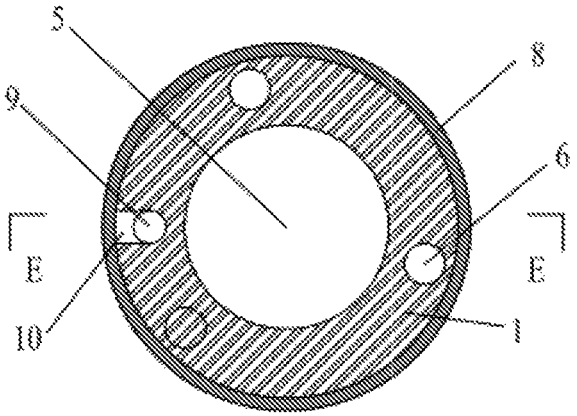
FIG. 5 is a cross sectional view (D-D section) of a middle part of the fitting II according to the embodiment of the present invention.

As shown in FIGS. 3, 4, and 5, the fitting II is a long circular pipe 1-2 whose inner and outer diameters are consistent with those of the fitting I. A fitting end of the fitting II is provided with two O-shaped water stop rings 7 that are used to stop water after the fitting I is connected to the fitting II. A pipe wall of the fitting II is provided with three water inlets 6 that form equal angles and are in communication with the water passage 3 of the fitting I and are used to introduce high pressure water for disturbing soil. An outer wall of a middle part of the fitting II is provided with a leather bag 8 which is in communication with at least one pressurization hole 9 by using a radial water stop leather bag pressurization passage 10. The least one pressurization hole 9 configured to pressurize the leather bag and the water inlets 6 configured to connect a high pressure water system are located at an end other than the fitting end. The leather bag 8 functions to fasten this apparatus to a shield tunnel segment 11, and block soil 12 or water (see FIG. 6).

The fitting II is provided with three blind holes 4-2 corresponding to the three bolt holes 4-1 on the fitting I, and a hole depth is not less than 10 mm. The fitting I is connected to the fitting II by using the bolts.

Figure 6:
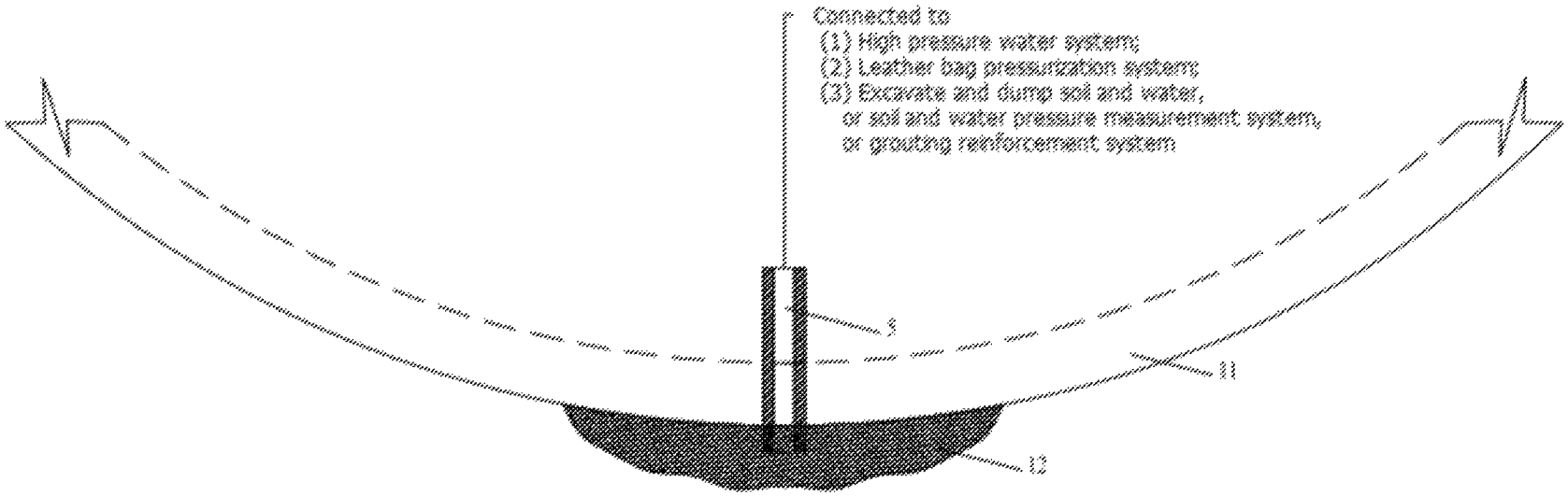
FIG. 6 is a schematic diagram of installation according to the present invention.

As shown in FIG. 6, the apparatus formed by assembling the fitting I and the fitting II is installed on the shield tunnel segment 11; a center of the apparatus is provided with axially through soil and water excavating and dumping holes 5 (diameters of the two soil and water excavating and dumping holes 5 provided on the two fittings are the same); high pressure water disturbs the soil 12 in a particular range at the back of the segment 11 by using this apparatus; disturbed soil and water are dumped from the soil and water excavating and dumping holes 5; when necessary, the soil and water excavating and dumping holes 5 may be used to excavate soil; or this apparatus is connected to a measurement system, so as to perform real-time monitoring on soil and water pressures after the disturbance; or this apparatus is connected to a grouting system, so as to perform grouting reinforcement on the disturbed soil.

What is claimed is:

1. An apparatus for disturbing soil encircling a shield tunnel, the apparatus comprising a fitting I and a fitting II connected by means of three bolts wherein each two of the three bolts form an angle of 120° there-between;

the fitting I is a first circular pipe; an end surface of a fitting end of the fitting I is provided with a water passage; a pipe wall of the pipe is provided with 2-8 water spouts; and an angle of 60° is formed between each of the water spouts and a radial direction;

the fitting II is a second circular pipe whose inner and outer diameters are same as those of the fitting I respectively; a fitting end of the fitting II is provided with two O-shaped water stop rings; a pipe wall of the fitting II is provided with three water inlets in communication with the water passage of the fitting I wherein each two of the three water inlets form an angle of 120° there-between; an outer wall of a middle part of the fitting II is provided with a leather bag; the leather bag is in communication with a water stop leather bag pressurization hole by using a radial water stop leather bag pressurization passage; the water stop leather bag pressurization hole and communication ports of the water inlets open to an end other than the fitting end of the fitting II; and centers of the fitting I and the fitting II are provided with through soil and water excavating and dumping holes extending parallel to the axis of the fitting I and the axis of the fitting II respectively, and diameters of the two soil and water excavating and dumping holes provided on the two fittings are the same.

2. The apparatus for disturbing soil encircling a shield tunnel according to claim 1, wherein an outer diameter of the fitting I is 70-110 mm; a wall thickness is 15-20 mm; a diameter of each of the water spouts is 10-12 mm; the water passage is an annular groove with a groove depth of 1 mm; and three bolt holes are provided on the fitting I and are configured for connecting to the fitting II wherein the three bolt holes are arranged with an angle of 120° between each two of the bolt holes.

3. The apparatus for disturbing soil encircling a shield tunnel according to claim 2, wherein the fitting II is provided with three blind holes corresponding to the three bolt holes provided on the fitting I, and a hole depth is 10-15 mm.

* * * * *